US005454196A

United States Patent [19]

Gaines et al.

[11] Patent Number: 5,454,196

[45] Date of Patent: Oct. 3, 1995

[54] INCLINABLE STAIRWAY

[76] Inventors: Samuel L. Gaines, 119 Coosa Ct., Montgomery, Ala. 36119; Alfred L. Gaines, 10101 Van Vlissingen, Chicago, Ill. 60617

[21] Appl. No.: 236,105

[22] Filed: May 2, 1994

[51] Int. Cl.[6] ..... E04F 11/00

[52] U.S. Cl. ..... 52/183; 14/69.5

[58] Field of Search ..... 14/69.5, 71.1; 52/183; 182/1

[56] References Cited

U.S. PATENT DOCUMENTS 298,212 5/1884 Knight ..... 14/72.5 X
4,539,781 9/1985 McCoy ..... 52/183

FOREIGN PATENT DOCUMENTS 22933 7/1905 United Kingdom ..... 182/1

*Primary Examiner*—Ramon S. Britts
*Assistant Examiner*—James A. Lisehora

[57] ABSTRACT

An inclinable stairway for providing a staircase in one orientation and a ramp in another orientation comprising a pair of spaced, opposed, and upwardly extended side walls, each side wall having opposed and upwardly extended front and rear edges with an inclined edge extended upwardly from the front edge to the rear edge in a stair-step fashion; a pair of spaced, opposed and articulated upper support members, each upper support member having a lower end and an upper end with the upper end pivotally coupled to the top edge of a side wall, each upper support member comprised of a linkage of elongated bracing elements pivotally coupled end-to-end with the bracing elements in the linkage aligned along the inclined edge of an adjacent side wall to define a staircase configuration, and the bracing elements in the linkage linearly extended above an adjacent side wall from the top edge thereof to a location adjacent to the base plate to define a ramp configuration; a plurality of step members coupled to alternating and opposed pairs of bracing elements; and an actuator mechanism coupled to the upper support members, the actuator mechanism having one orientation for placing the upper support members and step members in the staircase configuration and another orientation for placing the upper support members and step members in the ramp configuration.

1 Claim, 3 Drawing Sheets

FIG. 4
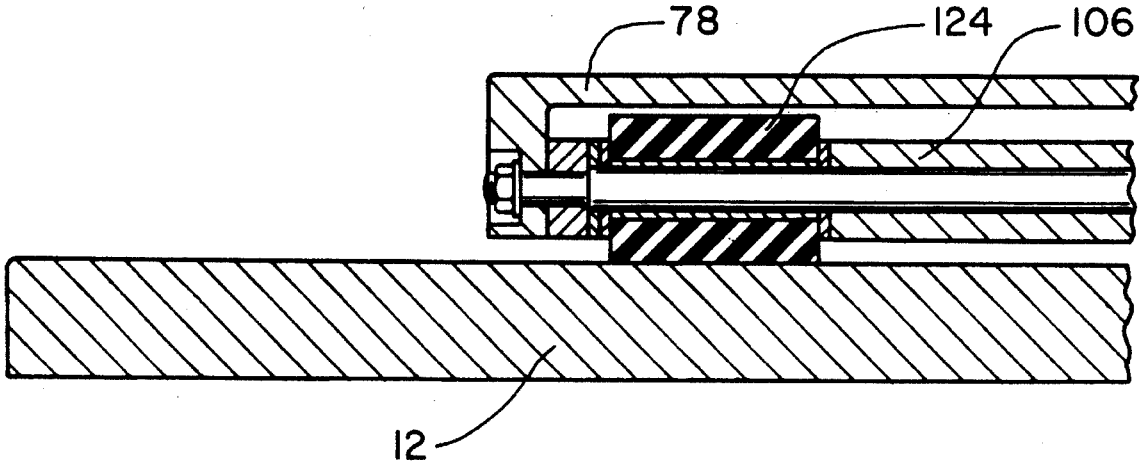
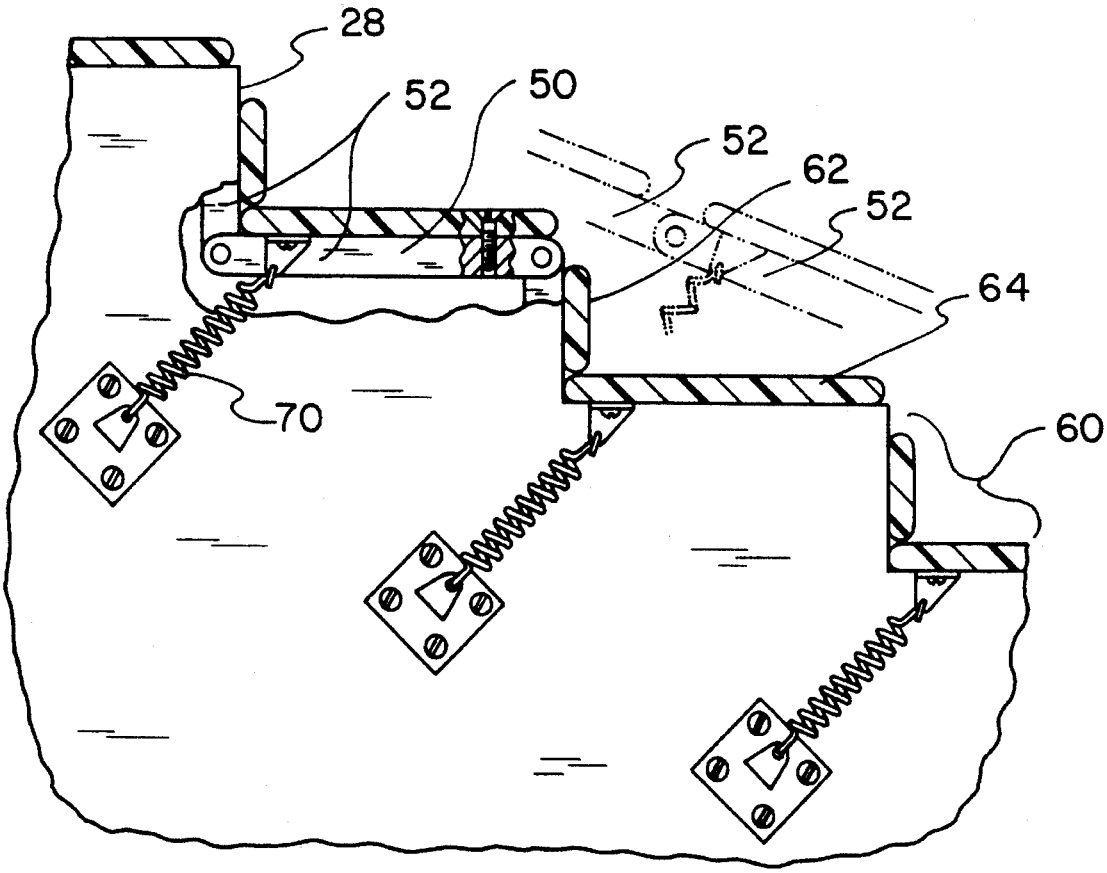
FIG. 5

INCLINABLE STAIRWAY

BACKGROUND OF THE INVENTION

1. Field of the Invention

The present invention relates to an inclinable stairway and more particularly pertains to providing a staircase in one orientation and a ramp in another orientation with an inclinable stairway.

2. Description of the Prior Art

The use of support structures is known in the prior art. More specifically, support structures heretofore devised and utilized for the purpose of providing a stairway or a ramp are known to consist basically of familiar, expected and obvious structural configurations, notwithstanding the myriad of designs encompassed by the crowded prior art which have been developed for the fulfillment of countless objectives and requirements.

By way of example, U.S. Patent Des. 304,499 to Rogers et al. discloses a folding stair unit. U.S. Pat. No. 3,493,077 to Doten discloses a folding stairway for automobile, camper and the like. U.S. Pat. No. 4,550,534 to Mariano et al. discloses an attic staircase. U.S. Pat. No. 4,559,659 to Hunter, Jr. discloses a power operated wheelchair ramp. U.S. Pat. No. 4,912,796 to Crump discloses an adjustable height wheelchair ramp with supporting legs.

While these devices fulfill their respective, particular objective and requirements, the aforementioned patents do not describe an inclinable stairway that can be placed in a staircase configuration or a ramp configuration.

In this respect, the inclinable stairway according to the present invention substantially departs from the conventional concepts and designs of the prior art, and in doing so provides an apparatus primarily developed for the purpose of providing a staircase in one orientation and a ramp in another orientation.

Therefore, it can be appreciated that there exists a continuing need for new and improved inclinable stairway which can be used for providing a staircase in one orientation and a ramp in another orientation. In this regard, the present invention substantially fulfills this need.

SUMMARY OF THE INVENTION

In the view of the foregoing disadvantages inherent in the known types of support structures now present in the prior art, the present invention provides an improved inclinable stairway. As such, the general purpose of the present invention, which will be described subsequently in greater detail, is to provide a new and improved inclinable stairway and method which has all the advantages of the prior art and none of the disadvantages.

To attain this, the present invention essentially comprises, in combination, a planar and essentially rectangular base plate having opposed front and rear edges and opposed side edges extended therebetween. A pair of spaced, opposed and upwardly extended side walls is included and disposed upon the base plate and aligned with the side edges thereof with each side wall having an elongated and essentially horizontal slot disposed therethrough with the slots of the pair aligned about a common axis of symmetry and each side wall further having opposed and upwardly extended front and rear edges with an inclined edge extended upwardly from the front edge to the rear edge in a stair-step fashion to terminate at an essentially horizontal top edge. A top plate is extended between the top edges of the side walls to define am upper platform. A pair of spaced, opposed and articulated upper support members is included with each upper support member having a lower end and an upper end with the upper end pivotally coupled to the top edge of a side wall and each upper support member comprised of a linkage of elongated bracing elements pivotally coupled end-to-end with the bracing elements in the linkage aligned along the inclined edge of an adjacent side wall to define a staircase configuration, and the bracing elements in the linkage linearly extended above an adjacent side wall from the top edge thereof to a location adjacent to the base plate to define a ramp configuration. A plurality of step members is included with each step member having a face plate extended over and coupled to alternate and opposed pairs of bracing elements and a bottom plate extended over and coupled to the opposed pairs of bracing elements adjacent to the face plates. A plurality of spaced and opposed orientation springs is included with each orientation spring having a first end coupled to a bottom plate and a second end extended downwards at an angle therefrom and coupled to an adjacent side wall, each orientation spring adapted to urge the step members into the staircase configuration. A pair of spaced and opposed lower support members is included with each lower support member having a first end pivotally coupled to the lower end of an upper support member and a second end extended outwardly therefrom to a location near the front edge of the base plate. A bottom plate is extended between the lower support members to define an inclinable lower platform in a ramp configuration and a lower step in the staircase configuration. A pair of actuator members is included with each actuator member having an upper end coupled to the upper end of an upper support member and a bottom end coupled to the lower end thereof and each actuator member comprised of a linkage of two elongated actuator elements pivotally coupled end-to-end with each actuator member having a retracted orientation for placing the upper support members, step members, and lower platform in a staircase configuration and an extended orientation for placing the upper support members, step members, and lower platform in a ramp configuration. A pair of spaced and opposed hand rails is included with each hand rail having a upwardly extended first member coupled to the bottom plate, a upwardly extended second member coupled to the top plate, and a cross rail coupled therebetween. A pair of spaced and opposed ramp support rods is included with each ramp support rod having a first end and a second end with the first end pivotally coupled to an actuator member and the second end disposed through an adjacent slot on a sidewall and extended under the upper platform.

An actuator mechanism is coupled to the base plate and to the second ends of the ramp support rods. The actuator mechanism includes a first pair and a second pair of spaced and opposed carriage guides disposed along the extent of the base plate. An essentially rectangular and planar carriage is slidably disposed between the carriage guides with the carriage having opposed front and rear edges, opposed side edges extended therebetween, a central opening disposed therethrough, a threaded eyelet centrally disposed thereon near the rear edge thereof and extended upwards therefrom, a plurality of spaced and opposed planar wedge pairs disposed along the extent of the carriage, each wedge pair having a bottom edge coupled to the carriage and an inclined edge extended upwards therefrom, each inclined edge of each wedge pair adapted to contact and linearly extend a step member, a stroke sensor activating bar extended across the central opening between adjacent wedge pairs, a first pair of rollers with each roller coupled between a side edge thereof a second end of a lower support member, and a second pair of rollers with each roller coupled to a side edge adjacent to the rear edge thereof. A motor is centrally disposed on the base plate near the rear edge of the carriage with the motor having a fixed stator and a rotatable rotor. Power transmission means are included for providing power to energize the motor. Power transforming means are included and coupled between the motor and power transmission means for transforming power supplied through the power transmission means to a form usable by the motor. A drive rod is included and has a threaded first end and a second end with the first end disposed within the eyelet of the carriage. Rotational means are coupled between the rotor of the motor and the second end of the drive rod for allowing the transfer of rotational motion from the rotor of the motor to the drive rod. A pair of ramp extension rods is included with each ramp extension rod having a first end coupled to a side edge of the carriage nears the rear edge thereof and a second end extended therefrom and coupled with the second end of a ramp support rod. A pair of stroke sensor switches is included with each stroke sensor switch coupled to the base plate on opposite sides of the stroke sensor activating bar. Each stroke sensor switch is coupled to the power transmission means and is adapted to cut off power to the motor when contact is made with the stroke sensor activating bar when the carriage is rolled forward in one direction or backward in another direction. First switch means are coupled between the power transmission means and the power transforming means with the first switch means having one orientation for energizing the motor and another orientation for de-energizing the motor. Lastly, second switch means are coupled between the first switch means and power transmission means with the second switch means having one orientation for axially rotating the drive rod in one direction with the motor, whereby pulling the carriage toward the motor, thus allowing the orientation springs to retract the step members and the ramp extension rods and ramp support rods to retract the actuator members for placing the upper support members, step members, and lower platform in the staircase configuration, the second switch means having another orientation for axially rotating the drive rod in another direction with the motor, whereby pushing the carriage away from the motor, thus allowing the wedge pairs to linearly extend the step members and the ramp extension rods and ramp support rods to extend the actuator members for placing the upper support members, step members, and lower platform in the ramp configuration.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved inclinable stairway which has all the advantages of the prior art support structures and none of the disadvantages.

It is another object of the present invention to provide a new and improved inclinable stairway which may be easily and efficiently manufactured and marketed.

It is a further object of the present invention to provide a new and improved inclinable stairway which is of durable and reliable construction.

An even further object of the present invention is to provide a new and improved inclinable stairway which is susceptible of a low cost of manufacture with regard to both materials and labor, and which accordingly is then susceptible of low prices of sale to the consuming public, thereby making such an inclinable stairway economically available to the buying public.

Still yet another object of the present invention is to provide a new and improved inclinable stairway which provides in the apparatuses and methods of the prior art some of the advantages thereof, while simultaneously overcoming some of the disadvantages normally associated therewith.

Even still another object of the present invention is to provide a new and improved inclinable stairway for providing a staircase in one orientation and a ramp in another orientation.

Lastly, it is an object of the present invention to provide a new and improved inclinable stairway comprising a pair of spaced, opposed, and upwardly extended side walls, each side wall having opposed and upwardly extended front and rear edges with an inclined edge extended upwardly from the front edge to the rear edge in a stair-step fashion; a pair of spaced, opposed and articulated upper support members, each upper support member having a lower end and an upper end with the upper end pivotally coupled to the top edge of a side wall, each upper support member comprised of a linkage of elongated bracing elements pivotally coupled end-to-end with the bracing elements in the linkage aligned along the inclined edge of an adjacent side wall to define a staircase configuration, and the bracing elements in the linkage linearly extended above an adjacent side wall from the top edge thereof to a location adjacent to the base plate to define a ramp configuration; a plurality of step members coupled to alternating and opposed pairs of bracing elements; and actuator means coupled to the upper support members, the actuator means having one orientation for placing the upper support members and step members in the staircase configuration and another orientation for placing the upper support members and step members in the ramp configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a cross-sectional view depicting the interrelation between the base plate, intermediate ramp, and carriage therebetween.

FIG. 5 is a cross-sectional view of the coupling between the articulated upper support members, the step members, and the orientation springs shown in both a staircase configuration and a ramp configuration.

The same reference numerals refer to the same parts through the various Figures.

DESCRIPTION OF THE PREFERRED EMBODIMENT

Figure 1:
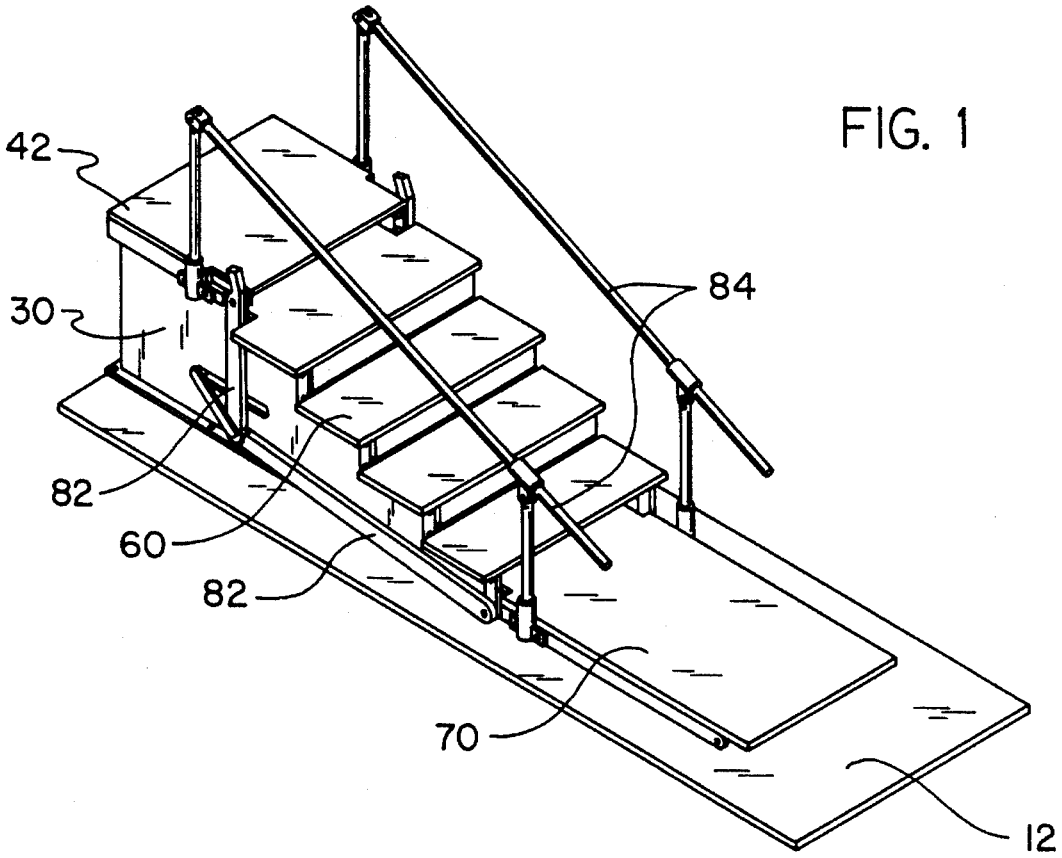
FIG. 1 is a perspective view of the preferred embodiment of the inclinable stairway constructed in accordance with the principles of the present invention.
Figure 2:
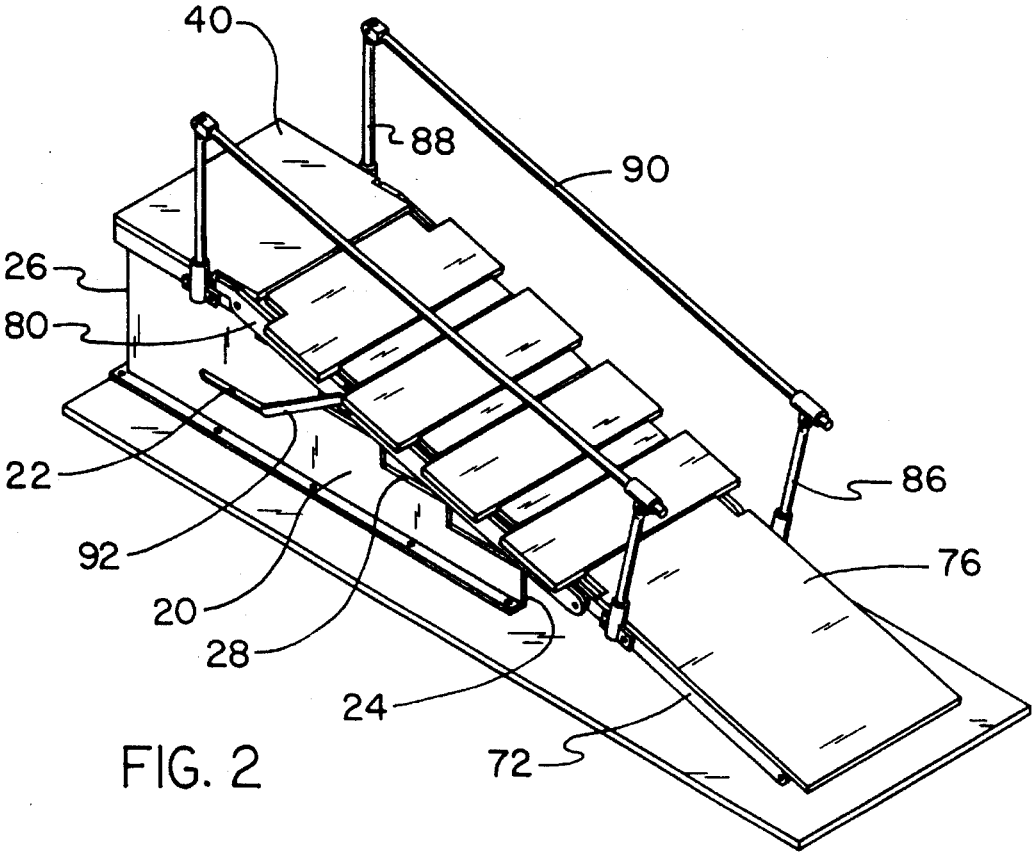
FIG. 2 is a perspective view of the present invention in a ramp configuration.
Figure 3:
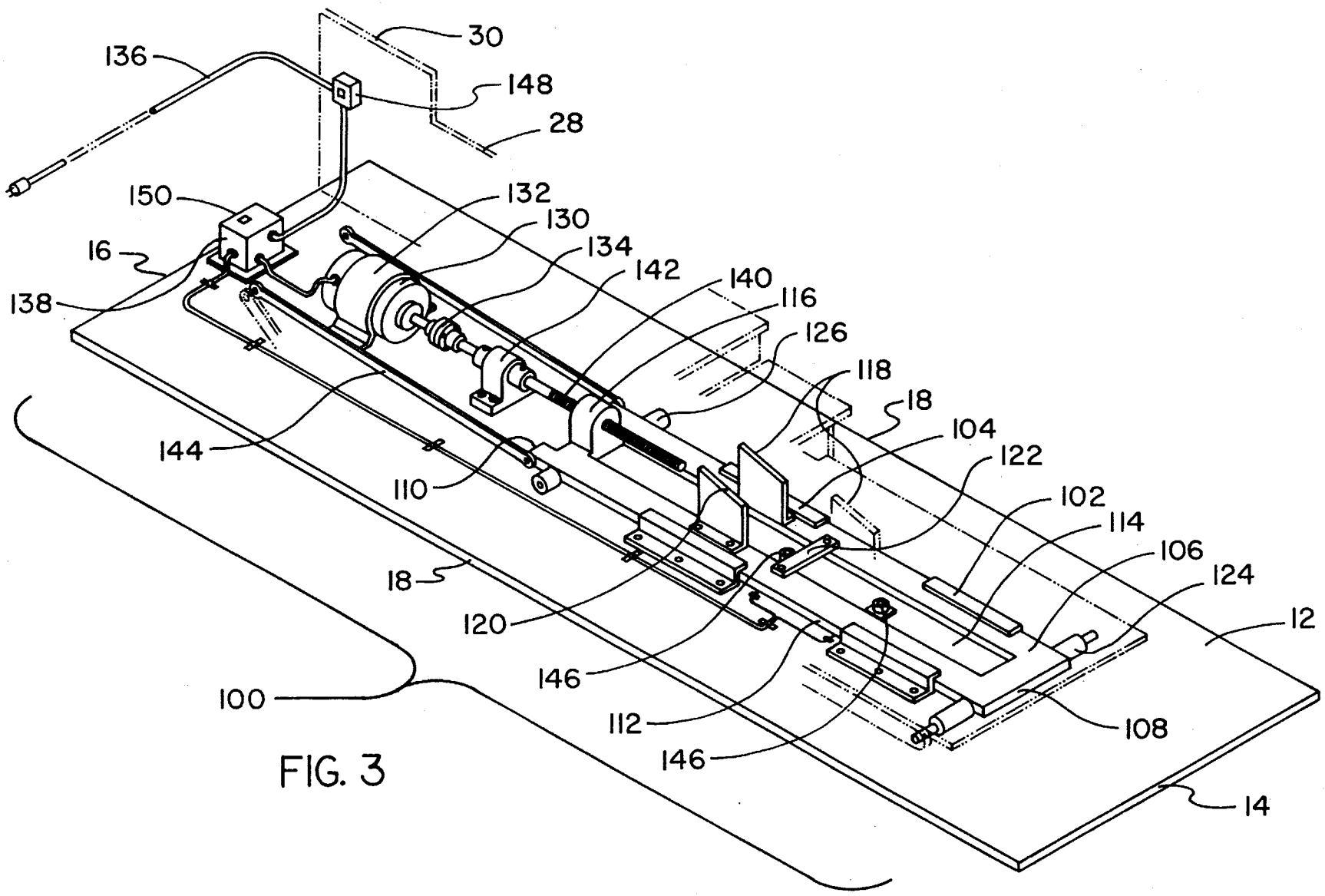
FIG. 3 is an interior perspective view of the actuator mechanism used to place the device in a staircase configuration in one orientation or a ramp configuration in another orientation.

With reference now to the drawings, and in particular, to FIG. 1 thereof, the preferred embodiment of the new and improved inclinable stairway embodying the principles and concepts of the present invention and generally designated by the reference number 10 will be described.

Specifically, the present invention includes 12 major components. The major components are the base plate, side walls, top plate, upper support members, step members, orientation springs, lower support members, bottom plate, actuator members, hand rails, ramp support rods, and actuator mechanism. These components are interrelated to provide the intended function.

More specifically, it will be noted in the various Figures that the first major component is the base plate 12. The base plate is planar and essentially rectangular in structure. The base plate has opposed front and rear edges 14, 16 and opposed side edges 18 extended therebetween. The base plate provides the foundation for the present invention. It is adapted to be positioned on a generally level surface.

The second major component is the side walls 20. The present invention includes a pair of spaced, opposed, and upwardly extended side walls. The side walls are disposed upon the base plate 12 and aligned with the side edges.18 thereof. Each side wall has an elongated and essentially horizontal slot 22 disposed therethrough in approximately a central location on the wall. The slots formed on the pair of side walls are aligned about a common axis of symmetry. Each side wall further has opposed and upwardly extended front and rear edges 24, 26 with an inclined edge 28 extended upwardly from the front edge to the rear edge in a stair step fashion. The inclined edge terminates at an essentially horizontal top edge 30. The side walls in combination with the base plate create a skeletal stairway configuration adapted to hold and contain the other components of the invention.

The third major component is the top plate 40. The top plate is extended between the top edges 30 of the side walls. The top plate in combination with the upper portion of the side walls define an upper platform 42. This upper platform is adapted to be located in front of a door or entrance for allowing access to and from the present invention.

The fourth major component is the upper support members 50. The present invention includes a pair of spaced, opposed, and articulated upper support members. Each upper support member has a lower end and an upper end. The upper end is pivotally coupled to the top edge of the side wall 30. Each upper support member is comprised of a linkage of elongated bracing elements 52. The bracing elements are pivotally coupled end-to-end. The bracing elements and the linkage are aligned in one position along the inclined edge 28 of an adjacent side wall to define a staircase configuration. The bracing elements in the linkage can also be positioned to linearly extend above an adjacent side wall from the top edge 30 thereof to a location adjacent to the base plate 12 to define a ramp configuration. Other components of the present invention are positioned based on these two configurations.

The fifth major component is the step members 60. The present invention includes a plurality of step members. Each step member has a face plate 62 extended over and coupled to alternate and opposed pairs of bracing elements. Each step member also has a bottom plate 64 extended over and coupled to the opposed pairs of bracing elements adjacent to those bracing elements with face plates coupled thereto. Consequently, this configuration creates a pattern of alternate face plates and bottom plates extended along the pair of upper support members.

The sixth major component is the orientation springs 70. The present invention includes a plurality of spaced and opposed orientation springs. Each orientation spring has a first end coupled to a bottom plate 64 of a step member. Each orientation spring also has a second end extended downwards at an angle from the bottom plate and coupled to an adjacent side wall 20. Each orientation spring is adapted to urge the step members 60 into the staircase configuration. Each orientation spring is also adapted to hold the step members securely in place when the step members are placed in the ramp configuration.

The seventh major component is the lower support members 72. The present invention includes a pair of spaced and opposed lower support members. Each lower support member has a first end pivotally coupled to the lower end of an upper support member 50. Each lower support member also has a second end extended from the first end to a location near the front edge of the base plate 12.

The eighth major component is the bottom plate 76. The bottom plate is extended between the lower support members. The bottom plate is adapted to be angularly extended in combination with the lower support members to define an inclinable lower platform in the ramp configuration. The bottom plate is also adapted to be positioned in an essentially horizontal manner in combination with the lower support members to define a lower step that is positioned adjacent to the base plate in a staircase configuration.

The ninth major component is the actuator members 80. The present invention includes a pair of actuator members. Each actuator member has one end coupled to the upper end of an upper support member 50. Each actuator member also has a bottom end coupled to the lower end of an upper support member. Each actuator member is comprised of a linkage of two elongated actuator elements 82. The actuator elements are pivotally coupled end-to-end. Each actuator member has a retracted orientation for placing the upper support members 50, step members 60, and lower platform 70 in a staircase configuration. Each actuator member also has an extended orientation for placing the upper support members, step members, and lower platform in a ramp configuration.

The tenth major component is the hand rails 84. The present invention includes a pair of spaced and opposed hand rails. Each hand rail has an upwardly extended first member 86 coupled to the lower support member 72. Each hand rail also has an upwardly extended second member 88 coupled to the top plate 40. A cross rail 90 is coupled between the first member and the second member. The hand rails allow a user to guide himself when moving up or down the present invention when placed in a stair configuration or a ramp configuration.

The eleventh major component is the ramp support rods 92. The present invention includes a pair of spaced and opposed ramp support rods. Each ramp support rod has a first end and a second end. The first end is pivotally coupled to an actuator member 80. The second end is disposed through an adjacent slot 72 on a side wall and extended under the upper platform 42. The ramp support rods are adapted to transfer forces for extending or retracting the actuator members.

The twelfth major component is the actuator mechanism 100. The actuator mechanism is coupled to the base plate 12 and to the second ends of the ramp support rods 92. The actuator mechanism includes 11 sub-components. The sub-components are the carriage guides, carriage, motor, power transmission means, power transforming means, drive rod, rotational means, ramp extension rods, stroke sensor switches, first switch means, and second switch means. These sub-components are interrelated to provide the intended function.

The first sub-component of the actuator mechanism is the carriage guides. The present invention includes a first pair and a second pair of spaced and opposed carriage guides 102, 104. The pairs of carriage guides are disposed along the extent of the base plate 12. The carriage guides are adapted to limit the transverse motion of an object placed therebetween yet allow lateral motion along the base plate.

The second sub-component of the actuator mechanism is the carriage 106. The carriage is essentially rectangular and planar is structure. The carriage is slidably disposed between the carriage guides. The carriage has opposed front and rear edges 108, 110 and opposed side edges 112 extended therebetween. The carriage has a central opening 114 disposed therethrough. A threaded eyelet 110 is centrally disposed on the carriage near the rear edge thereof. The eyelet extends upwards from the carriage. A plurality of spaced and opposed planar wedge pairs 118 are disposed along the extent of the carriage. Each wedge pair has a bottom edge coupled to the carriage and an inclined edge 120 extended upwards therefrom. Each inclined edge of each wedge pair is adapted to contact and linearly extend a step member 60 for use in the ramp configuration. The carriage also includes a stroke sensor activating bar 122. The stroke sensor activating bar is extended across the central opening between adjacent wedge pairs. The stroke sensor activating bar is adapted to actuate a sensor disposed within the opening of the carriage. The carriage also includes a first pair of rollers 124. Each roller of the first pair is coupled between the side edges thereof and a second end of a lower support member 72. The carriage includes a second pair of rollers 126. Each roller of the second pair is coupled to a side edge adjacent to the rear edge 110 thereof.

The third sub-component of the actuator mechanism is the motor 130. The motor is centrally disposed on the base plate 12 near the rear edge 110 of the carriage. The motor has a fixed stator 132 and a rotatable rotor 134.

The fourth sub-component of the actuator mechanism is the power transmission means 136. The power transmission means is used for providing power to energize the motor. The power transmission means is adapted to be coupled to an external power source such as a battery or power grid.

The fifth sub-component of the actuator mechanism is the power transforming means 138. The power transforming means is coupled between the motor 130 and the power transmission means 136. The power transforming means is used for transforming power supplied through the power transmission means to a form usable by the motor. For example, the power transmission means can be utilized to convert alternating current energy to direct current energy for driving a direct current motor.

The sixth sub-component of the actuator mechanism is the drive rod. The drive rod has a threaded first end and a second end. The first end is disposed within the eyelet 116 of the carriage. The second end is adapted to be coupled to a torque producing mechanism for rotating the drive rod.

The seventh sub-component of the actuator mechanism is the rotational means 142. The rotational means is coupled between the rotor 134 of the motor and the second end of the drive rod. The rotational means allow the transfer of rotational motion from the rotor of the motor to the drive rod 140. This rotational motion is subsequently transferred to linear motion through the eyelet of the carriage for moving the carriage forwards or backwards.

The eighth sub-component of the actuator mechanism is the ramp extension rods 144. The present invention includes a pair of ramp extension rods. Each ramp extension rod has a first end and a second end. The first end is coupled to a side edge 112 of the carriage near the rear edge 110 thereof. The second end is extended from the first end and coupled with the second end of the ramp support rod 92. The ramp extension rods transfer the linear motion of the carriage to the ramp support rods.

The ninth sub-component of the actuator mechanism is the stroke sensor switches 146. The present invention includes a pair of stroke sensor switches. Each stroke sensor switch is coupled to the base plate 12 on opposite sides of the stroke sensor activating bar 122. Each stroke sensor switch is coupled between the power transmission means 136 and the motor for controlling power thereto. Each stroke sensor switch is adapted to cut off power to the motor 130 when contact is made with the stroke sensor activating bar when the carriage is rolled forward in one direction or backwards in another direction.

The tenth sub-component of the actuator mechanism is a first switch means 148. The first switch means is coupled between the power transmission means 136 and the power transforming means 138. The first switch means has one orientation for energizing the motor 130. The first switch means has another orientation for de-energizing the motor.

The eleventh sub-component of the actuator mechanism is the second switch means 150. The second switch means is coupled between the first switch means 148 and the power transmission means 136. The second switch means has one orientation for axially rotating the drive rod 140 in one direction with the motor 130, whereby pulling the carriage 106 towards the motor, thus allowing the orientation springs 70 to retract the step members 60 and the ramp extension rods 144 and the ramp support rods 92 to retract the actuator members 80 for placing the upper support members 50, step members, and lower platform 78 in the staircase configuration. The second switch means has another orientation for axially rotating the drive rod in another direction with the motor, whereby pushing the carriage away from the motor and allowing the wedge pairs 118 to linearly extend the ramp members and the ramp extension rods and the ramp support rods to extend the actuator members for placing the upper support members, step members, and lower platform in the ramp configuration.

The major components of the present invention are made of a rigid material such as metal. The present invention extends into the ramp configuration through the use of a reversible ⅛ horse power motor. The present invention is designed to be used primarily by handicapped people. The ramp extends with a push of a button. The present invention can be used at home as well as at businesses.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An inclinable stairway for providing a staircase in one orientation and a ramp in another orientation comprising, in combination:

a planar and essentially rectangular base plate having opposed front and rear edges and opposed side edges extended therebetween;

a pair of spaced, opposed and upwardly extended side walls disposed upon the base plate and aligned with the side edges thereof, each side wall having an elongated and essentially horizontal slot disposed therethrough with the slots of the pair aligned about a common axis of symmetry, each side wall further having opposed and upwardly extended front and rear edges with an inclined edge extended upwardly from the front edge to the rear edge in a stair-step fashion to terminate at an essentially horizontal top edge;

a top plate extended between the top edges of the side walls to define an upper platform;

a pair of spaced, opposed and articulated upper support members, each upper support member having a lower end and an upper end with the upper end pivotally coupled to the top edge of one, of the side walls, each upper support member comprised of a linkage of elongated bracing elements pivotally coupled end-to-end with the bracing elements in the linkage aligned along the inclined edge of one of the side walls to define a staircase configuration, and the bracing elements in the linkage linearly extendable to define a ramp configuration;

a plurality of step members, each step member having a face plate extended over and coupled to alternate and opposed pairs of bracing elements and a bottom plate extended over and coupled to the opposed pairs of bracing elements adjacent to the face plates;

a plurality of spaced and opposed orientation springs, each orientation spring having a first end coupled to one of the bottom plates and a second end extended downwards at an angle therefrom and coupled to an adjacent side wall, each orientation spring adapted to urge the step members into the staircase configuration;

a pair of spaced and opposed lower support members, each lower support member having a first end pivotally coupled to the lower end of an upper support member a second extended outwardly therefrom to a location near the front edge of the base plate;

a bottom plate extended between the lower support members to define an inclinable lower platform in a ramp configuration and a lower step in the staircase configuration;

a pair of actuator members, each actuator member having an upper end coupled to the upper end of an upper support member and a bottom end coupled to the lower end thereof, each actuator member comprised of a linkage of two elongated actuator elements pivotally coupled end-to-end with each actuator member having a retracted orientation for placing the upper support members, step members, and lower platform in a staircase configuration and an extended orientation for placing the upper support members, step members, and lower platform in a ramp configuration;

a pair of spaced and opposed hand rails, each hand rail having a upwardly extended first member coupled to the bottom plate, a upwardly extended second member coupled to the top plate, and a cross rail coupled therebetween;

a pair of spaced and opposed ramp support rods, each ramp support rod having a first end and a second end, the first end pivotally coupled to an actuator member, the second end disposed through an adjacent slot on a sidewall and extended under the upper platform; and an actuator mechanism coupled to the base plate and to the second ends of the ramp support rods, the actuator mechanism further comprising:

a first pair and a second pair of spaced and opposed carriage guides disposed along the extent of the base plate;

an essentially rectangular and planar carriage slidably disposed between the carriage guides, the carriage having opposed front and rear edges, opposed side edges extended therebetween, a central opening disposed therethrough, a threaded eyelet centrally disposed thereon near the rear edge thereof and extended upwards therefrom, a plurality of spaced and opposed planar wedge pairs disposed along the extent of the carriage, each wedge pair having a bottom edge coupled to the carriage and an inclined edge extended upwards therefrom, each inclined edge of each wedge pair adapted to contact and linearly extend a step member, a stroke sensor activating bar extended across the central opening between adjacent wedge pairs, a first pair of rollers with each roller coupled between a side edge thereof and a second end of a lower support member, and a second pair of rollers with each roller coupled to a side edge adjacent to the rear edge thereof;

a motor centrally disposed on the base plate near the rear edge of the carriage, the motor having a fixed stator and a rotatable rotor;

power transmission means for providing power to energize the motor;

power transforming means coupled between the motor and power transmission means for transforming power supplied through the power transmission means to a form usable by the motor;

a drive rod having a threaded first end and a second end with the first end disposed within the eyelet of the carriage;

rotational means coupled between the rotor of the motor and the second end of the drive rod for allowing the transfer of rotational motion from the rotor of the motor to the drive rod;

a pair of ramp extension rods, each ramp extension rod having a first end coupled to a side edge of the carriage near the rear edge thereof and a second end extended therefrom and coupled with the second end of a ramp support rod;

a pair of stroke sensor switches, each stroke sensor switch coupled to the base plate on opposite sides of the stroke sensor activating bar and coupled to the power transmission means, each stroke sensor switch adapted to cut off power to the motor when contact is made with the stroke sensor activating bar when the carriage is rolled forward in one direction or backward in another direction;

a first switch means coupled between the power transmission means and the power transforming means, the first switch means having one orientation for energizing the motor and another orientation for de-energizing the motor; and a second switch means coupled between the first switch means and power transmission means, the second switch means having one orientation for axially rotating the drive rod in one direction with the motor, whereby pulling the carriage toward the motor, thus allowing the orientation springs to retract the step members and the ramp extension rods and ramp support rods to retract the actuator members for placing the upper support members, step members, and lower platform in the staircase configuration, the second switch means having another orientation for axially rotating the drive rod in another direction with the motor, whereby pushing the carriage away from the motor, thus allowing the wedge pairs to linearly extend the step members and the ramp extension rods and ramp support rods to extend the actuator members for placing the upper support members, step members, and lower platform in the ramp configuration.

* * * * *